US006874710B2

(12) United States Patent
Ishii et al.

(10) Patent No.: US 6,874,710 B2
(45) Date of Patent: Apr. 5, 2005

(54) FUEL INJECTION VALVE

(75) Inventors: Nobutaka Ishii, Gunma (JP); Hideo Kato, Tochigi (JP); Tomoichi Misawa, Gunma (JP); Nobuaki Kobayashi, Gunma (JP)

(73) Assignee: Hitachi Unisia Automotive, Ltd., Kanagawa (JP)

( * ) Notice: Subject to any disclaimer, the term of this patent is extended or adjusted under 35 U.S.C. 154(b) by 164 days.

(21) Appl. No.: 10/419,799

(22) Filed: Apr. 22, 2003

(65) Prior Publication Data

US 2003/0209615 A1 Nov. 13, 2003

(30) Foreign Application Priority Data

May 13, 2002 (JP) ..... 2002-137209

(51) Int. Cl.[7] ..... B05B 1/30; F02M 59/00; F02M 39/00

(52) U.S. Cl. ..... 239/585.1; 239/585.4; 239/585.5; 239/533.2; 239/533.3; 239/533.9; 239/585.3

(58) Field of Search ..... 239/585.1–585.5, 239/533.2, 533.3, 533.7, 533.8, 533.9, 533.11, 88–93; 251/129.15, 129.21, 127

(56) References Cited

U.S. PATENT DOCUMENTS 4,385,339 A * 5/1983 Takada et al. ..... 361/154
5,275,341 A 1/1994 Romann et al.
5,544,816 A * 8/1996 Nally et al. ..... 239/585.5
5,692,723 A * 12/1997 Baxter et al. ..... 251/129.21
5,996,911 A * 12/1999 Gesk et al. ..... 239/585.1

FOREIGN PATENT DOCUMENTS

JP 10-122085 A 5/1998

* cited by examiner

*Primary Examiner*—Davis Hwu
(74) *Attorney, Agent, or Firm*—Sughrue Mion, PLLC

(57) ABSTRACT

A fuel injection valve includes: a magnetic barrel body made of a magnetic material and shaped substantially into a barrel, a core barrel made of a magnetic material and shaped substantially into a barrel, a valve seat member positioned on a downstream side of the core barrel and disposed in the magnetic barrel body, a valve body positioned between the core barrel and the valve seat member, an O-ring positioned in a vicinity of a flange portion of the magnetic barrel body, a fuel filter assembly disposed at the first end on the fuel's influx side of the magnetic barrel body. A flange of the fuel filter assembly is made of a material lower in hardness than the magnetic material of the magnetic barrel body. The flange of the fuel filter assembly has a diameter larger than the diameter of the flange portion of the magnetic barrel body.

19 Claims, 6 Drawing Sheets

FUEL INJECTION VALVE

BACKGROUND OF THE INVENTION

1. Field of the Invention

The present invention relates to a fuel injection valve preferably used for injecting fuel into an internal combustion engine which is installed, for example, on a vehicle.

2. Description of the Related Art

In general, a fuel injection valve for injecting fuel into an internal combustion engine installed, for example, on a vehicle has the following construction:

Opening and closing a fuel passage in a valve casing by means of a valve body injects the fuel in the fuel passage into the internal combustion engine.

U.S. Pat. No. 5,275,341 {equivalent of Japanese Patent Unexamined Publication No. Heisei 10 (1998)-122085} discloses an electromagnetically operated valve.

BRIEF SUMMARY OF THE INVENTION

It is an object of the present invention to provide a fuel injection valve for injecting fuel into an internal combustion engine installed, for example, on a vehicle.

It is another object of the present invention to provide the fuel injection valve that can prevent a damage which may be caused to an O-ring in a progression of being mounted on fuel's influx side of a magnetic cylindrical body.

It is still another object of the present invention to assuredly seal an area between the magnetic cylindrical body and a fuel delivery pipe, with the thus obtained damage-free O-ring.

According to a first aspect of the present invention, there is provided a fuel injection valve, comprising:

I) a magnetic barrel body made of a magnetic material and shaped substantially into a barrel, the magnetic barrel body including;
   a) a fuel passage, and
   b) a flange portion disposed at a first end on a fuel's influx side connected to a fuel delivery pipe, the flange portion having a diameter so formed as to expand;

II) a core barrel made of a magnetic material and shaped substantially into a barrel, the core barrel being inserted into the magnetic barrel body;

III) a valve seat member positioned on a downstream side of the core barrel and disposed in the magnetic barrel body, the valve seat member including a valve seat for communicating a fuel;

IV) a valve body positioned between the core barrel and the valve seat member, the valve body being disposed in the magnetic barrel body, the valve body being so displaced as to be seated on the valve seat of the valve seat member and to be separated from the valve seat of the valve seat member;

V) an O-ring positioned in a vicinity of the flange portion of the magnetic barrel body, the O-ring being so disposed on an outer periphery on the fuel's influx side of the magnetic barrel body as to seal an area defined between the fuel delivery pipe and the magnetic barrel body, the O-ring in a progress of being mounted on the outer periphery on the fuel's influx side of the magnetic barrel body being free from abutting on the flange portion of the magnetic barrel body; and VI) a fuel filter assembly disposed at the first end on the fuel's influx side of the magnetic barrel body, the fuel filter assembly collecting a foreign matter in the fuel flowing in from the fuel delivery pipe, the fuel filter assembly including a flange abutting on the flange portion of the magnetic barrel body, the flange of the fuel filter assembly being made of a material lower in hardness than the magnetic material of the magnetic barrel body, the flange of the fuel filter assembly having a diameter larger than the diameter of the flange portion of the magnetic barrel body.

According to a second aspect of the present invention, there is provided a fuel delivery system, comprising:

a fuel delivery-pipe formed with a boss portion; and a fuel injection valve adapted to be mounted to the fuel delivery pipe in such a manner as to be connected to the boss portion, the fuel injection valve comprising:

I) a magnetic barrel body made of a magnetic material and shaped substantially into a barrel, the magnetic barrel body including;
   a) a fuel passage, and
   b) a flange portion disposed at a first end on a fuel's influx side connected to a fuel delivery pipe, the flange portion having a diameter so formed as to expand;

II) a core barrel made of a magnetic material and shaped substantially into a barrel, the core barrel being inserted into the magnetic barrel body;

III) a valve seat member positioned on a downstream side of the core barrel and disposed in the magnetic barrel body, the valve seat member including a valve seat for communicating a fuel;

IV) a valve body positioned between the core barrel and the valve seat member, the valve body being disposed in the magnetic barrel body, the valve body being so displaced as to be seated on the valve seat of the valve seat member and to be separated from the valve seat of the valve seat member;

V) an O-ring positioned in a vicinity of the flange portion of the magnetic barrel body, the O-ring being so disposed on an outer periphery on the fuel's influx side of the magnetic barrel body as to seal an area defined between the fuel delivery pipe and the magnetic barrel body, the O-ring in a progress of being mounted on the outer periphery on the fuel's influx side of the magnetic barrel body being free from abutting on the flange portion of the magnetic barrel body; and VI) a fuel filter assembly disposed at the first end on the fuel's influx side of the magnetic barrel body, the fuel filter assembly collecting a foreign matter in the fuel flowing in from the fuel delivery pipe, the fuel filter assembly including a flange abutting on the flange portion of the magnetic barrel body, the flange of the fuel filter assembly being made of a material lower in hardness than the magnetic material of the magnetic barrel body, the flange of the fuel filter assembly having a diameter larger than the diameter of the flange portion of the magnetic barrel body.

The other objects and features of the present invention will become understood from the following description with reference to the accompanying drawings.

BRIEF DESCRIPTION OF THE SEVERAL VIEWS OF THE DRAWINGS

FIG. 3 is an enlarged cross section showing a magnetic barrel body 3, a fuel filter assembly 19, an O-ring 18 and the like.

DETAILED DESCRIPTION OF THE EMBODIMENTS

In the following, an embodiment of the present invention will be described in detail with reference to the accompanying drawings.

For ease of understanding, the following description will contain various directional terms, such as, left, right, upper, lower, forward, rearward and the like. However, such terms are to be understood with respect to only a drawing or drawings on which the corresponding part of element is illustrated.

Hereinafter described in detail referring to FIG. 1 to FIG. 6 is construction of a fuel injection valve 1, according to an embodiment of the present invention.

Figure 2:
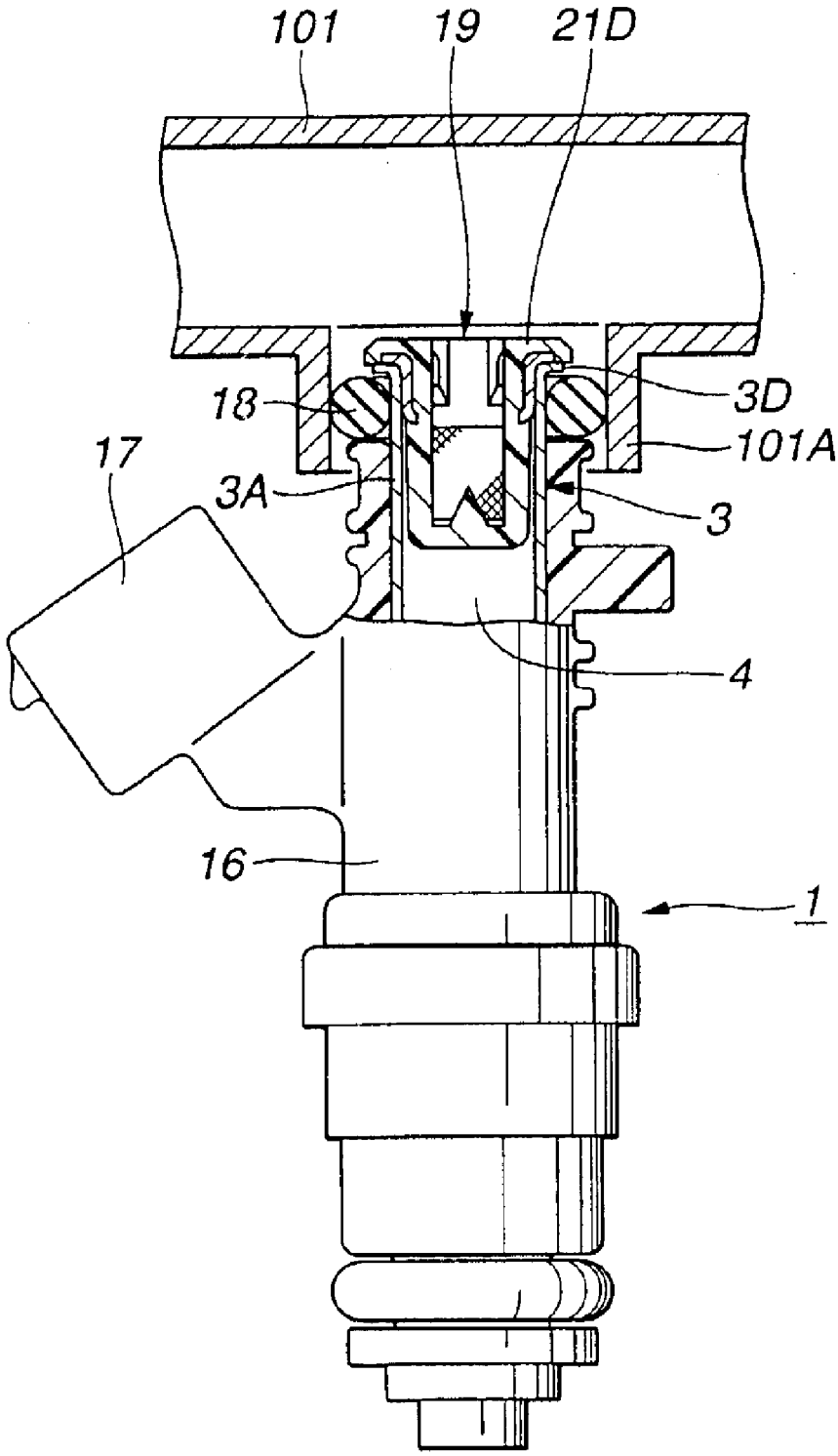
FIG. 2 is a partly broken front view of the fuel injection valve 1 connected to a fuel delivery pipe 101.

As is seen in FIG. 2, fuel injection valve 1 is connected to a boss portion 101A of a fuel delivery pipe 101. Fuel flows in fuel delivery pipe 101. Fuel injection valve 1 injects the fuel into an internal combustion engine (not shown).

Figure 1:
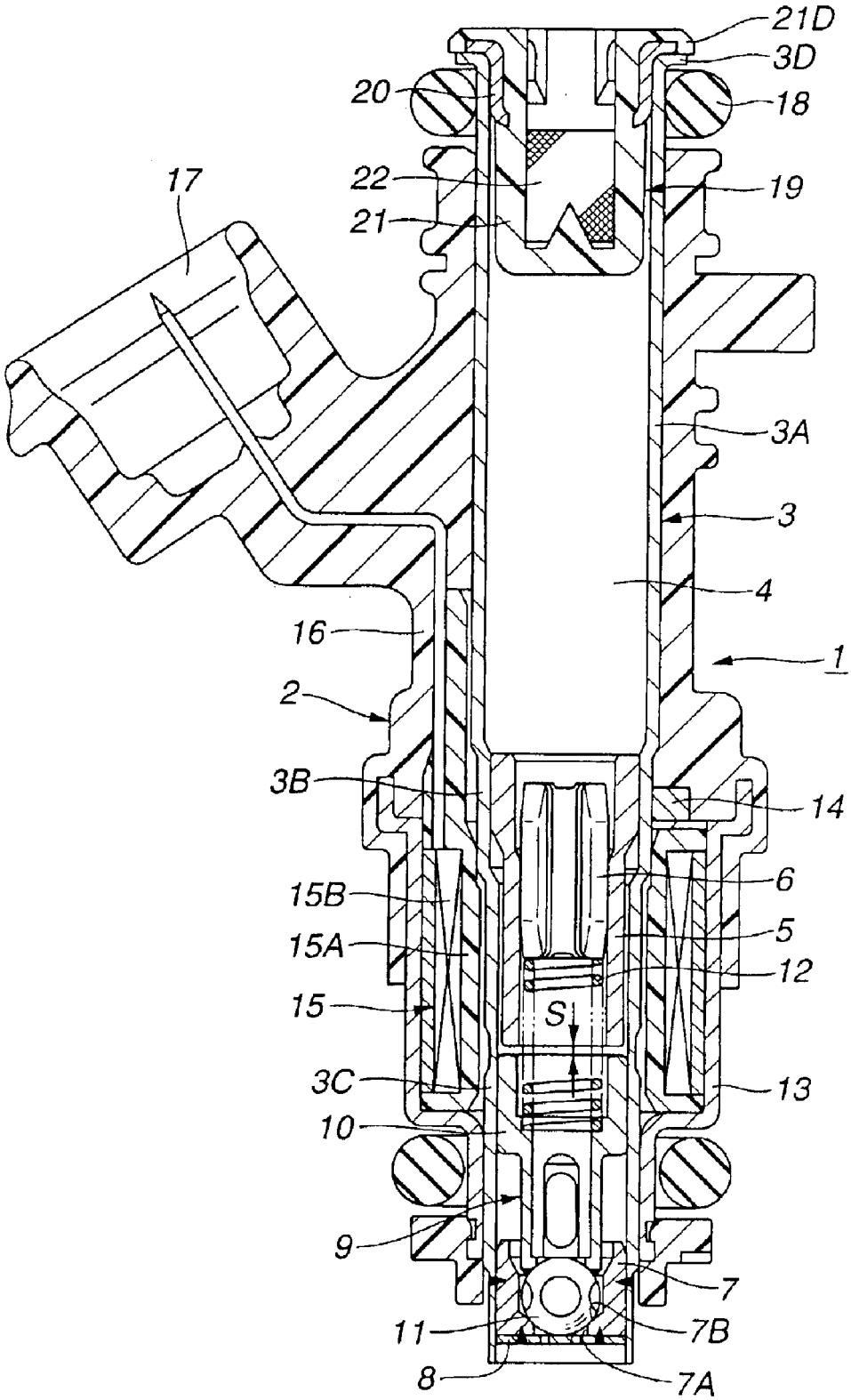
FIG. 1 is a cross section of a fuel injection valve 1, according to an embodiment of the present invention.

As is seen in FIG. 1, there is provided a valve casing 2 which is an outer shell of fuel injection valve 1. Valve casing 2 includes a magnetic barrel body 3, a yoke 13, a resin cover 16 and the like—to be described afterward.

There is provided magnetic barrel body 3 which constitutes a body of valve casing 2. Magnetic barrel body 3 is shaped substantially into a stepped barrel. Magnetic barrel body 3 is a stepped thin metal pipe formed in the following manner:

1. Prepare a magnetized stainless material and the like.
2. Press (deep drawing and the like) the thus prepared stainless steel.

Hereinabove, magnetic barrel body 3 shaped substantially into the stepped barrel includes a large diameter portion 3A, a middle diameter portion 3B and a small diameter portion 3C. Large diameter portion 3A is axially disposed on a first side (upper in FIG. 1) of magnetic barrel body 3. Middle diameter portion 3B in the axial middle part of magnetic barrel body 3 is smaller than large diameter portion 3A. Small diameter portion 3C is axially disposed on a second side (lower in FIG. 1) of magnetic barrel body 3, and smaller than middle diameter portion 3B.

Moreover, large diameter portion 3A has a first end (upper in FIG. 1) on fuel's influx side. Around substantially an entire circumference of the first end of large diameter portion 3A, there is provided a flange portion 3D having an expanded diameter and shaped substantially into a disk.

As is seen in FIG. 2, magnetic barrel body 3 is connected to fuel delivery pipe 101, with the fuel's influx side of large diameter portion 3A inserted into boss portion 101A of fuel delivery pipe 101.

As is seen in FIG. 1, there is provided a fuel passage 4 in magnetic barrel body 3. The first end (upper in FIG. 1) on the fuel's influx side of large diameter portion 3A is an influx port. Fuel passage 4 axially extends from the influx port to an after-described valve seat member 7.

There is provided a core barrel 5 inserted into magnetic barrel body 3. In combination with an after-described anchor portion 10 (of a valve body 9) and yoke 13, core barrel 5 forms a closed magnetic circuit of an electromagnetic coil 15. Moreover, core barrel 5 defines a position for opening valve body 9. Moreover, core barrel 5 is press fitted into middle diameter portion 3B of magnetic barrel body 3. Core barrel 5 has an end face (lower in FIG. 1) opposed to an end face (upper in FIG. 1) of anchor portion 10 of valve body 9 with a small gap S defined therebetween.

There is provided a spring receiver 6 press fitted into core barrel 5. Spring receiver 6 is formed substantially into a thin barrel. Press fitting spring receiver 6 into core barrel 5 can hold an after-described valve spring 12 between spring receiver 6 and core barrel 5. To what extent spring receiver 6 is press fitted into core barrel 5 is an index of adjusting a biasing force of valve spring 12.

There is provided valve seat member 7 which is positioned downstream core barrel 5 and disposed in small diameter portion 3C of magnetic barrel body 3. Valve seat member 7 shaped substantially into a barrel includes a injection port 7A, and a valve seat 7B. Valve seat 7B surrounding injection port 7A constitutes a fuel path. Injection port 7A injects the fuel out of fuel passage 4. Valve seat member 7 is press fitted into small diameter portion 3C of magnetic barrel body 3. Moreover, valve seat member 7 has an outer periphery which is substantially entirely welded to small diameter portion 3C.

Moreover, a nozzle plate 8 is securely welded to a head end (lower in FIG. 1) of valve seat member 7 in such a position as to cover injection port 7A.

There is provided valve body 9 positioned between core barrel 5 and valve seat member 7. Valve body 9 is received in small diameter portion 3C of magnetic barrel body 3 in such a manner as to be axially displaced. Valve body 9 includes anchor portion 10 and a valve portion 11. Anchor portion 10 is, for example, made of magnetic metal. Moreover, anchor portion 10 is shaped substantially into a stepped barrel extending axially. Valve portion 11 is shaped substantially into a sphere. Valve portion 11 is fixed to a head end (lower in FIG. 1) of anchor portion 10. Moreover, valve portion 11 is seated on valve seat 7B of valve seat member 7 and moves away from valve seat 7B of valve seat member 7.

Ordinarily, the biasing force of valve spring 12 allows valve portion 11 of valve body 9 to be seated on valve seat 7B of valve seat member 7, with gap S defined between the end face (lower in FIG. 1) of core barrel 5 and the end face (upper in FIG. 1) of anchor portion 10.

On the other hand, energizing electromagnetic coil 15 allows core barrel 5, anchor portion 10, yoke 13 and the like to form the closed magnetic circuit. With this, anchor portion 10 of valve body 9 is magnetically absorbed to core barrel 5. Opposing the biasing force of valve spring 12, valve portion 11 may move away from valve seat 7B of valve portion 11.

Valve spring 12 is disposed between spring receiver 6 and valve body 9. Valve spring 12 ordinarily biases valve body 9 in such a direction that valve portion 11 can be seated on valve seat 7B of valve seat member 7, thus closing the valve body 9. The biasing force of valve spring 12 can be adjusted by the extent that spring receiver 6 is press fitted into core barrel 5.

There is provided yoke 13 disposed outside magnetic barrel body 3. Yoke 13 is made, for example, of magnetic metal, and shaped substantially into a stepped barrel, thus constituting a part of valve casing 2. Yoke 13 is securely press fitted over small diameter portion 3C of magnetic barrel body 3.

Between yoke 13 and middle diameter portion 3B of magnetic barrel body 3, there is provided a connection core 14 made of magnetic material. Connection core 14 is shaped-substantially into an English alphabet "C" in such a manner as to surround an outer periphery of middle diameter portion 3B.

There is provided electromagnetic coil 15 between magnetic barrel body 3 and yoke 13. Electromagnetic coil 15 is substantially constituted of a coil bobbin 15A and a coil 15B. Coil bobbin 15A is made of resin material and shaped substantially into a barrel. Coil 15B winds around coil bobbin 15A. Coil bobbin 15A has an inner periphery fitted to middle diameter portion 3B of magnetic barrel body 3.

Energizing electromagnetic coil 15 via an after-described connector 17 can form the closed magnetic circuit through small diameter portion 3C (of magnetic barrel body 3), core barrel 5, anchor portion 10 (of valve body 9), yoke 13, and connection core 14. Core barrel 5 magnetically absorbing anchor 10 of valve body 9 can move valve portion 11 of valve body 9 away from valve seat 7B of valve seat member 7.

There is provided resin cover 16 around the outer periphery of magnetic barrel body 3. With yoke 13, connection core 14, electromagnetic coil 15 and the like assembled to the outer periphery of magnetic barrel body 3, resin cover 16 is formed by means of an injection molding and the like.

There is provided connector 17 which is integrated with resin cover 16. Connector 17 is used for energizing coil 15B of electromagnetic coil 15.

There is provided an O-ring 18 in the vicinity of flange portion 3D. O-ring 18 is fitted over the outer periphery of large diameter portion 3A of magnetic barrel body 3. With magnetic barrel body 3 connected to fuel delivery pipe 101, O-ring 18 is disposed between the outer periphery of large diameter portion 3A and an inner periphery of boss portion 101A of fuel delivery pipe 101, as is seen in FIG. 2.

There is provided a fuel filter assembly 19 on the fuel's influx side of large diameter portion 3A of magnetic barrel body 3. Fuel filter assembly 19 collects foreign matter in the fuel flowing from fuel delivery pipe 101 into fuel passage 4 in magnetic barrel body 3, thus purging the fuel.

Figure 3:
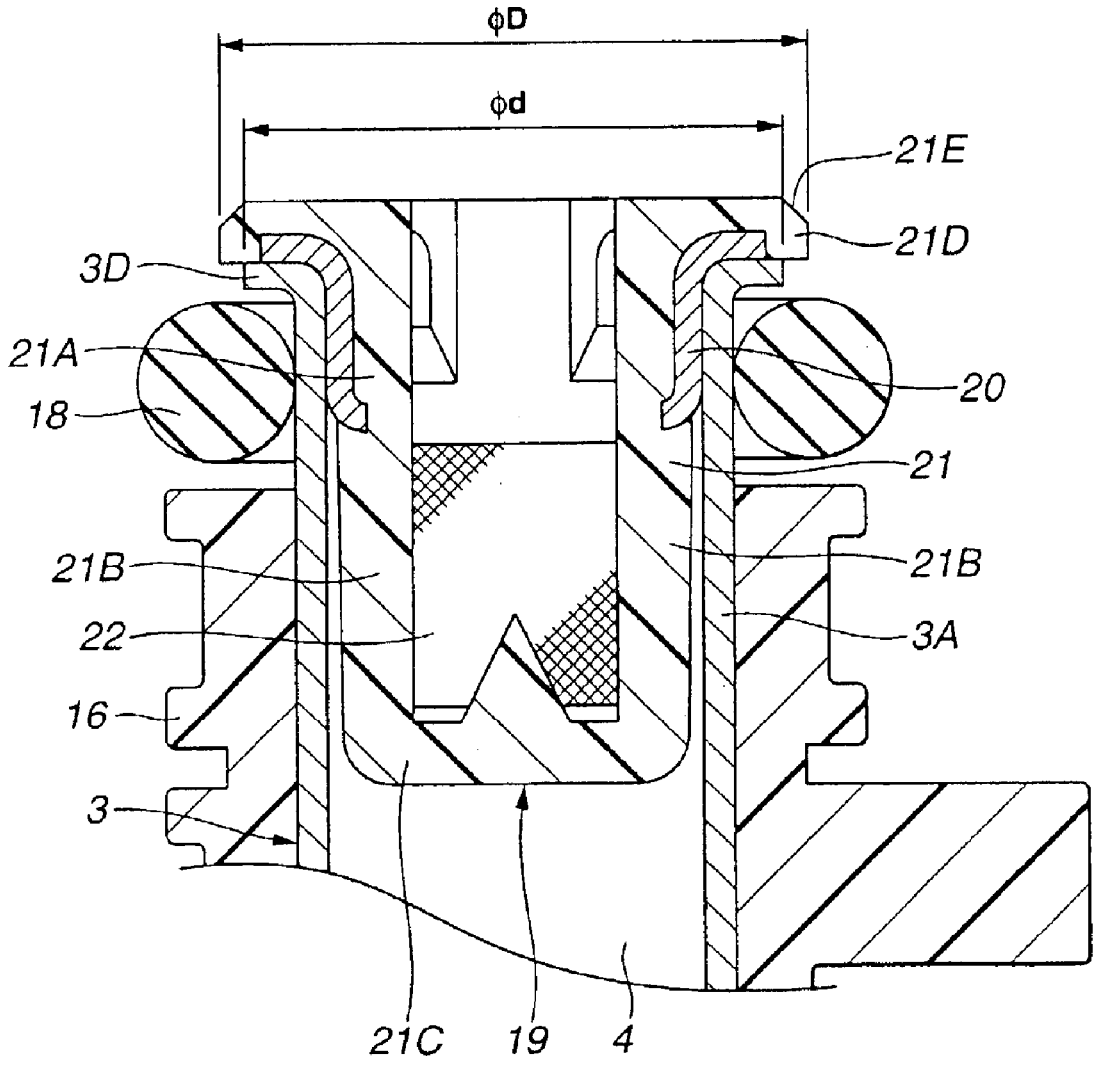
Figure 4:
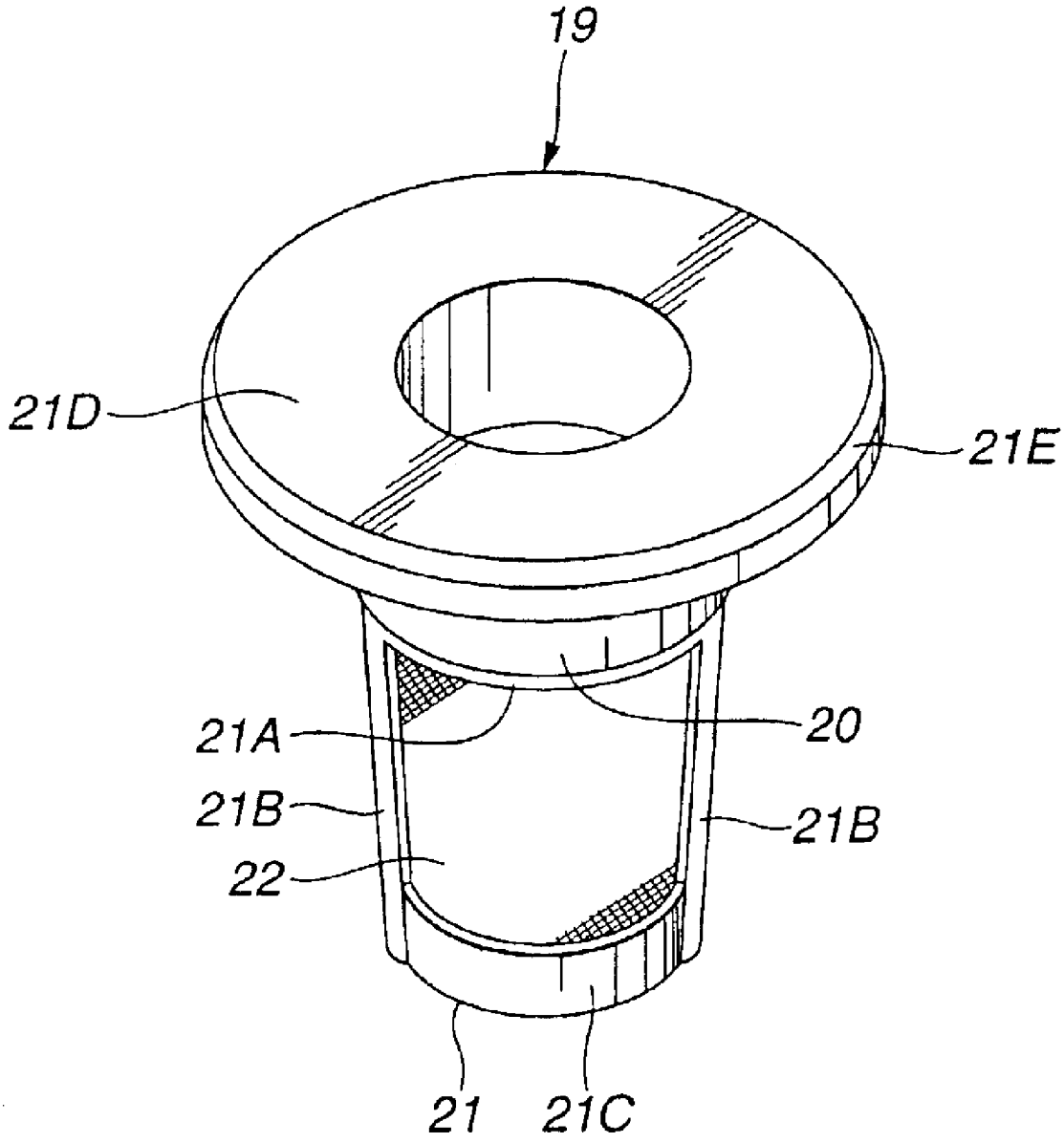
FIG. 4 is a perspective view of the fuel filter 19 alone.

Hereinabove, fuel filter assembly 19 is, as is seen in FIG. 3 and FIG. 4, substantially constituted of a core metal 20, a frame 21, and a filter 22. Core metal 20 is made of metal and shaped substantially into a barrel. Core metal 20 is press fitted into large diameter portion 3A of magnetic barrel body 3. Frame 21 is made of a resin material lower in hardness than the material of magnetic cylindrical body 3. For example, frame 21 is made of nylon, fluororesin and the like. Moreover, frame 21 is integrated with core metal 20 through the injection molding and the like, and extends substantially in a longitudinal direction of magnetic cylindrical body 3. Filter 22 is mounted on frame 21, thus filtering the fuel.

Frame 21 is an integration of members including a barrel portion 21A, two ribs 21B, a base plate 21C, and a large diameter flange 21D. Barrel portion 21A is disposed inside core metal 20. Two ribs 21B extend from barrel portion 21A toward middle diameter portion 3B of magnetic barrel body 3. Base plate 21C shaped substantially into a disk is disposed at a head end (lower in FIG. 4) of each of two ribs 21B.

Hereinabove, being positioned on the fuel's influx side of barrel portion 21A constituting frame 21, large diameter flange 21D is integrated with core metal 20. Outward from core metal 20, large diameter flange 21D is increased in diameter in a form of a disk.

As is seen in FIG. 3, large diameter flange 21D has an outer diameter $\phi D$ larger than an outer diameter $\phi d$ of flange portion 3D of magnetic barrel body 3, thus making $\phi D > \phi d$. With this, press fitting core metal 20 of fuel filter assembly 19 into large diameter portion 3A of magnetic barrel body 3 allows large diameter flange 21D to abut on flange portion 3D of magnetic barrel body 3, thus overhanging (or bulging) an outer periphery of large diameter flange 21D outward from the outer periphery of flange portion 3D of magnetic barrel body 3. The above overhanging (or bulging) covers an area around substantially an entire circumference of the outer peripheries.

Moreover, as is seen in FIG. 3, large diameter flange 21D has an end (on the fuel's influx side, upper in FIG. 3) which is formed with a chamfer portion 21E covering substantially an entire circumference of the outer periphery of large diameter flange 21D. Fitting O-ring 18 to the outer periphery of large diameter portion 3A of magnetic barrel body 3 in an after-described assembling process of fuel injection valve 1 allows O-ring 18 to gradually get increased in diameter along chamfer portion 21E so as to pass over large diameter flange 21D.

On the other hand, filter 22 is shaped substantially into a barrel or a bottomed barrel. Filter 22 has such a construction as to cover an open port surrounded by barrel portion 21A, two ribs 21B and base plate 21 C of frame 21.

Hereinafter described is the assembling process of fuel injection valve 1 having the construction described above, according to the embodiment of the present invention.

Prepare magnetic barrel body 3. From small diameter portion 3C's side, mount connection core 14 and electromagnetic coil 15 over middle diameter portion 3B of magnetic barrel body 3. From a head end (lower in FIG. 1) of small diameter portion 3C of magnetic barrel body 3, press fit yoke 13 over small diameter portion 3C of magnetic barrel body 3, in such a manner that yoke 13 can cover electromagnetic coil 15.

Then, assemble electromagnetic coil 15 and yoke 13 and the like over the outer periphery of magnetic barrel body 3. With the injection molding, form resin cover 16 and connector 17 in an area covering from the outer periphery of large diameter potion 3A of magnetic barrel body 3 to yoke 13.

Then, press fit valve seat member 7 into small diameter portion 3C of magnetic barrel body 3. With a laser welding and the like, secure valve seat member 7 to the head end of small diameter portion 3C of magnetic barrel body 3. From large diameter portion 3A's side, insert valve body 9 into magnetic barrel body 3, so as to dispose valve body 9 in small diameter portion 3C.

Then, from large diameter portion 3A's side, insert core barrel 5 into magnetic barrel body 3. Press fit core barrel 5 in the inner periphery of middle diameter portion 3B of magnetic barrel body 3, thereby allowing the end face (lower in FIG. 1) of core barrel 5 to face the end face (upper in FIG. 1) of anchor portion 10 of valve body 9 with gap S defined therebetween. Herein, gap S defined between the end face of anchor portion 10 and the end face of core barrel 5 determines a stroke for opening and closing valve body 9.

After press fitting core barrel 5 into magnetic barrel body 3: From large diameter portion 3A's side of magnetic barrel body 3, insert valve spring 12 and spring receiver 6. Then, press fit spring receiver 6 into core barrel 5 for adjusting the biasing force of valve spring 12.

Figure 5:
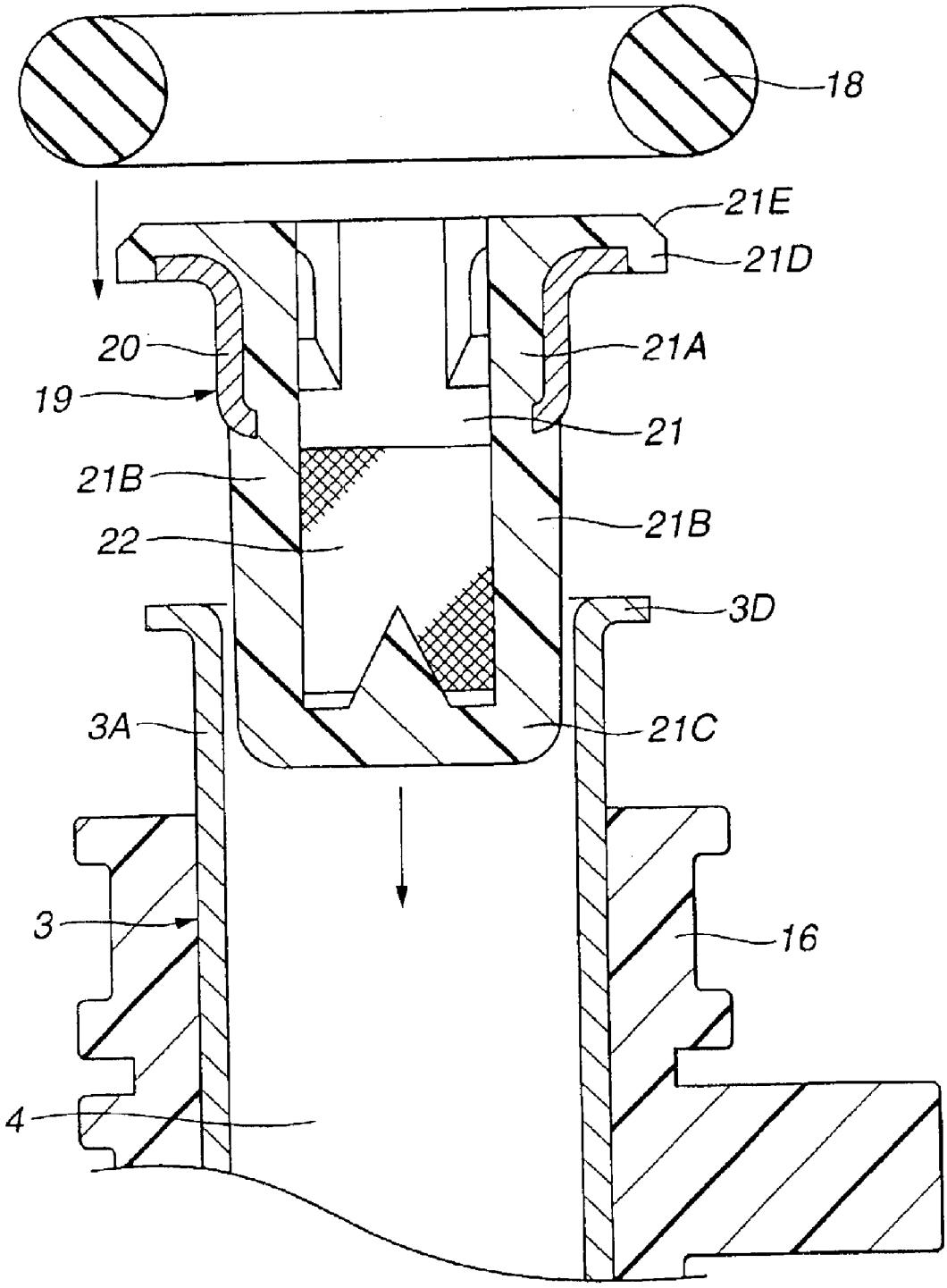
FIG. 5 is a cross section showing a state of the fuel filter assembly 19 in a progression of being mounted on the magnetic barrel body 3.
Figure 6:
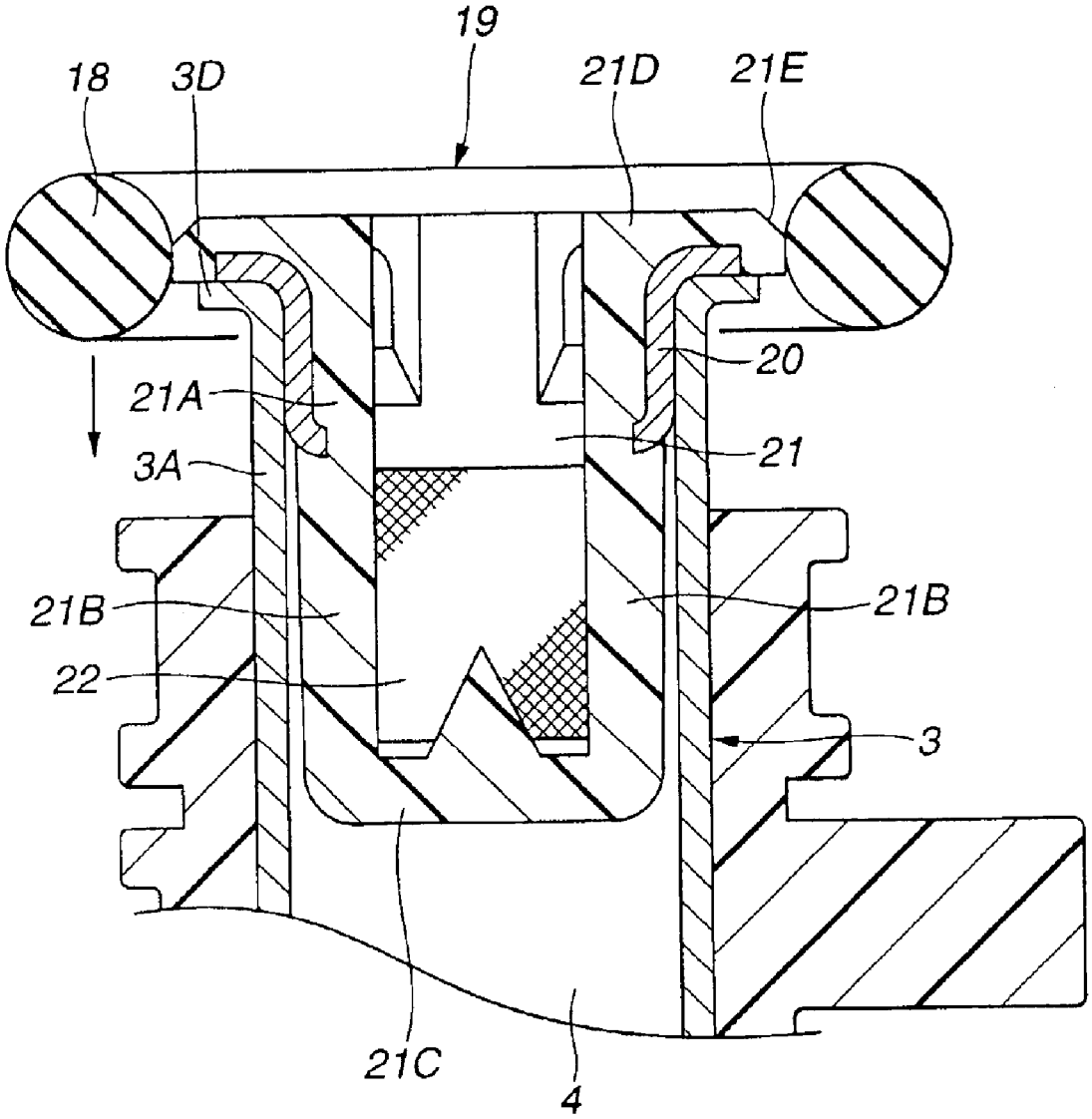
FIG. 6 is a cross section showing a state of the O-ring 18 in a progression of being mounted on an outer periphery of the magnetic barrel body 3.

As is seen in FIG. 5, insert fuel filter assembly 19 into large diameter portion 3A of magnetic barrel body 3. Then, press fit core metal 20 of fuel filter assembly 19 into large diameter portion 3A. With this, fuel filter assembly 19 mounts to magnetic barrel body 3 with large diameter flange 21D abutting on flange portion 3D of magnetic barrel body 3, as is seen in FIG. 6. In this state, the outer periphery of large diameter flange 21D overhangs (or bulges) outward from the outer periphery of flange portion 3D of magnetic barrel body 3. The above overhanging (or bulging) covers the area around substantially the entire circumference of the outer peripheries.

After mounting fuel filter assembly 19 to large diameter portion 3A of magnetic barrel body 3: From large diameter flange 21D's side of fuel filter assembly 19, mount O-ring 18 on the outer periphery of large diameter portion 3A of magnetic barrel body 3 so that the thus obtained state can have the following construction 1:

At the first end (upper in FIG. 1 and FIG. 3) on the fuel's influx side of magnetic barrel body 3, there is provided flange portion 3D having an increased diameter from large diameter portion 3A.

Construction 1: Around substantially the entire circumference, flange portion 3D has the outer periphery covered with the outer periphery of large diameter flange 21D (fitted to fuel filter assembly 19).

With the above construction 1, O-ring 18 passing over flange portion 3D of magnetic barrel body 3 abuts only on the outer periphery of large diameter flange 21D fitted to fuel filter assembly 19. In other words, O-ring 18 can avoid abutting on the outer periphery of flange portion 3D of magnetic barrel body 3. Even in the following case 1 and case 2, O-ring 18 can be assuredly free from any damage which may be caused by O-ring 18's abutment on flange portion 3D:

Case 1. The outer periphery of flange portion 3D is a hardened edge.

Case 2. A flash and the like (remnant) is caused to the outer periphery of flange portion 3D in production.

On the other hand, large diameter flange 21D fitted to fuel filter assembly 19 is made of a resin material and the like which is lower in hardness than the material of magnetic barrel body 3. Thereby, O-ring 18 even abutting on large diameter flange 21D can avoid the damage. Passing over large diameter flange 21D, the "damage-free" O-ring 18 can mount on the outer periphery of large diameter portion 3A of magnetic barrel body 3.

In addition, the end (upper in FIG. 1 and the like) on the fuel's influx side of large diameter flange 21D is formed with chamfer portion 21E covering substantially the entire circumference of the outer periphery of large diameter flange 21D. This construction allows O-ring 18 to smoothly pass over large diameter flange 21D along chamfer portion 21E with O-ring 18's diameter increased gradually, thus improving workability (operationability) of mounting O-ring 18.

As is seen in FIG. 2, the thus assembled fuel injection valve 1 is connected to fuel delivery pipe 101, by inserting the first end (upper in FIG. 2) on the fuel's influx side of magnetic barrel body 3 inserted into boss portion 101A of fuel delivery pipe 101.

In the above state, the first end (upper in FIG. 2) on the fuel's influx side of magnetic barrel body 3 is fitted with flange portion 3D having the outer periphery covered with large diameter flange 21D fitted to fuel filter assembly 19. With this, inserting the first end (upper in FIG. 2) of magnetic barrel body 3 into boss portion 101A of fuel delivery pipe 101 can prevent flange portion 3D from abutting on boss portion 101A and the like, resulting in prevention of any foreign matter such as cutting pieces and the like.

Being free from abutting on flange portion 3D of magnetic barrel body 3, an inner periphery (seal face) of boss portion 101A can avoid damage. Thereby, mounting fuel injection valve 1 on boss portion 101A of fuel delivery pipe 101 can bring about an assured adhesion between the outer periphery of O-ring 18 and the inner periphery of boss portion 101A, thus keeping excellent sealing therebetween.

Hereinafter described is operation of fuel injection valve 1 assembled as described above, according to the embodiment of the present invention.

As is seen in FIG. 1, energizing electromagnetic coil 15 from connector 17 allows core barrel 5, anchor portion 10 (of valve body 9), yoke 13 and the like to form the closed magnetic circuit. The thus formed closed magnetic circuit passes through gap S defined between anchor portion 10 (of valve body 9) and core barrel 5. As a result, valve body 9 is magnetically absorbed to core barrel 5 in such a manner as to be axially displaced opposing the biasing force of valve spring 12, thus moving valve portion 11 away from valve seat 7B of valve seat member 7. With this, the fuel delivered from fuel delivery pipe 101 into fuel passage 4 of magnetic barrel body 3 and thereafter purged through fuel filter assembly 19 is injected into an intake pipe of the internal combustion engine (not shown) via injection port 7A (of valve seat member 7) and nozzle plate 8.

On the other hand, stopping energizing electromagnetic coil 15 may allow valve portion 11 of valve body 9 to be seated on valve seat 7B of valve seat member 7 by means of the biasing force of valve spring 12, thus closing injection port 7A of valve seat member 7. Thus closed injection port 7A stops injecting the fuel into the intake pipe of the internal combustion engine.

Hereinabove, O-ring 18 sealing the area between the outer periphery of large diameter portion 3A of magnetic barrel body 3 and the inner periphery of boss portion 101A of fuel delivery pipe 101 can be free from any damage which may be caused by flange portion 3D of magnetic barrel body 3 in the assembly process of fuel injection valve 1. The above damage-free O-ring 18 can assuredly seal the area between the outer periphery of large diameter portion 3A of magnetic barrel body 3 and fuel delivery pipe 101, thus preventing leakage of the fuel therefrom. Long time prevention of the fuel leakage can improve reliability of fuel injection valve 1.

Mounting fuel injection valve 1 to boss portion 101A of fuel delivery pipe 101 allows the outer periphery of large diameter flange 21D (fitted to fuel filter assembly 19) to abut on the inner periphery of boss portion 101A, thus preventing flange portion 3D of magnetic barrel body 3 from abutting on the inner periphery of boss portion 101A.

Hereinabove, large diameter flange 21D (fitted to fuel filter assembly 19) is made of the soft resin material. Thereby, large diameter flange 21D even abutting on the inner periphery of boss portion 101A can prevent any damage to the inner periphery of boss portion 101A. With this, mounting fuel injection valve 1 to boss portion 101A of fuel delivery pipe 101 can bring about excellent sealing between the outer periphery of O-ring 18 and the inner periphery of boss portion 101A.

Having the construction, the assembling process and the operation described above, the fuel injection valve 1 according to the embodiment of the present invention can be summarized as below.

At the first end (upper in FIG. 1 and the like) on the fuel's influx side of fuel filter assembly 19, fuel injection valve 1 according to the embodiment of the present invention has large diameter flange 21D which is made of the soft resin and the like lower in hardness than the material of magnetic barrel body 3 and which has outer diameter $\phi D$ larger than outer diameter $\phi d$ of flange portion 3D. With the above construction, large diameter flange 21D abutting on flange portion 3D of magnetic barrel body 3 allows the outer periphery of large diameter flange 21D to overhang (or bulge) outward from the outer periphery of flange portion 3D of magnetic barrel body 3 around substantially the entire circumference of the peripheries.

With this, O-ring 18 in the progression of being fitted to the outer periphery of large diameter portion 3A of magnetic barrel body 3 may abut only on the outer periphery of large diameter flange 21D (fitted to fuel filter assembly 19), thus avoiding damage which may be caused by the abutment on the outer periphery of flange portion 3D of magnetic barrel body 3. The damage-free O-ring 18 can assuredly seal the area between the outer periphery of large diameter portion 3A of magnetic barrel body 3 and fuel delivery pipe 101, thus improving reliability of fuel injection valve 1.

Moreover described as below: In the progression of mounting fuel injection valve 1 to boss portion 101A of fuel delivery pipe 101, large diameter flange 21D (fitted to fuel filter assembly 19) preventing flange portion 3D of magnetic barrel body 3 from abutting on the inner periphery of boss portion 101A can prevent any damage to the inner periphery of boss portion 101A. With this, fuel injection valve 1 in the progression of being mounted to boss portion 101A of fuel delivery pipe 101 can keep excellent sealing between the outer periphery of O-ring 18 and the inner periphery of boss portion 101A.

Although the present invention has been described above by reference to a certain embodiment, the present invention is not limited to the embodiment described above. Modifications and variations of the embodiment described above will occur to those skilled in the art, in light of the above teachings.

More specifically, according to the embodiment of the present invention, the first end (upper in FIG. 1 and the like) on the fuel's influx side of the outer periphery of large diameter flange 21D is formed, around substantially the entire circumference, with chamfer portion 21E that is shaped substantially into the taper. The present invention is, however, not limited to the above. Any other configuration such as arc is applicable to chamfer portion 21E.

This application is based on a prior Japanese Patent Application No. P2002-137209 (filed on May 13, 2002 in Japan). The entire contents of the Japanese Patent Application No. P2002-137209 from which priority is claimed is incorporated herein by reference, in order to take some protection against mis-translation or omitted portions.

The scope of the present invention is defined with reference to the following claims.

What is claimed is:

1. A fuel injection valve, comprising:

I) a magnetic barrel body made of a magnetic material and shaped substantially into a barrel, the magnetic barrel body including;

a) a fuel passage, and b) a flange portion disposed at a first end on a fuel's influx side connected to a fuel delivery pipe, the flange portion having a diameter so formed as to expand;

II) a core barrel made of a magnetic material and shaped substantially into a barrel, the core barrel being inserted into the magnetic barrel body;

III) a valve seat member positioned on a downstream side of the core barrel and disposed in the magnetic barrel body, the valve seat member including a valve seat for communicating a fuel;

IV) a valve body positioned between the core barrel and the valve seat member, the valve body being disposed in the magnetic barrel body, the valve body being so displaced as to be seated on the valve seat of the valve seat member and to be separated from the valve seat of the valve seat member;

V) an O-ring positioned in a vicinity of the flange portion of the magnetic barrel body, the O-ring being so disposed on an outer periphery on the fuel's influx side of the magnetic barrel body as to seal an area defined between the fuel delivery pipe and the magnetic barrel body, the O-ring in a progress of being mounted on the outer periphery on the fuel's influx side of the magnetic barrel body being free from abutting on the flange portion of the magnetic barrel body; and VI) a fuel filter assembly disposed at the first end on the fuel's influx side of the magnetic barrel body, the fuel filter assembly collecting a foreign matter in the fuel flowing in from the fuel delivery pipe, the fuel filter assembly including a flange abutting on the flange portion of the magnetic barrel body, the flange of the fuel filter assembly being made of a material lower in hardness than the magnetic material of the magnetic barrel body, the flange of the fuel filter assembly having a diameter larger than the diameter of the flange portion of the magnetic barrel body.

2. The fuel injection valve as claimed in claim 1, wherein the magnetic material of the magnetic barrel body is stainless.

3. The fuel injection valve as claimed in claim 2, wherein the magnetic barrel body further comprises a large diameter portion, a middle diameter portion and a small diameter portion such that the magnetic barrel body is shaped substantially into a stepped barrel, and the large diameter portion is disposed axially on a first side of the magnetic barrel body, the middle diameter portion in an axial middle part of the magnetic barrel body is smaller than the large diameter portion, and the small diameter portion is disposed axially on a second side of the magnetic barrel body and smaller than the middle diameter portion.

4. The fuel injection valve as claimed in claim 3, wherein the large diameter portion has the first end on the fuel's influx side, and the flange portion having the expanded diameter and shaped substantially into a disk is disposed around substantially an entire circumference of the first end of the large diameter portion.

5. The fuel injection valve as claimed in claim 4, wherein on the fuel's influx side, the flange of the fuel filter assembly has an end which is formed with a chamfer portion covering substantially an entire circumference of an outer periphery of the flange.

6. The fuel injection valve as claimed in claim 5, wherein fitting the O-ring to an outer periphery of the large diameter portion of the magnetic barrel body allows the O-ring to gradually get increased in diameter along the chamfer portion so as to pass over the flange.

7. The fuel injection valve as claimed in claim 6, wherein the fuel filter assembly is substantially constituted of a core metal, a frame and a filter, the core metal is made of a metal and shaped substantially into a barrel, the core metal is press fitted into the large diameter portion of the magnetic barrel body, and the frame is made of a resin material lower in hardness than the magnetic material of the magnetic cylindrical body.

8. The fuel injection valve as claimed in claim 7, wherein the frame is made of at least one material selected from a group consisting of a nylon and a fluororesin.

9. The fuel injection valve as claimed in claim 8, wherein the frame is integrated with the core metal through an injection molding, and extends substantially in a longitudinal direction of the magnetic cylindrical body, and the filter is mounted on the frame, thus filtering the fuel.

10. The fuel injection valve as claimed in claim 9, wherein the frame is an integration of members including a barrel portion, a plurality of ribs, a base plate and the flange, the barrel portion is disposed inside the core metal, the plurality of the ribs extend from the barrel portion toward the middle diameter portion of the magnetic barrel body, and the base plate shaped substantially into a disk is disposed at a head end of each of the plurality of the ribs.

11. The fuel injection valve as claimed in claim 10, wherein the flange positioned on the fuel's influx side of the barrel portion constituting the frame is integrated with the core metal, and outward from the core metal, the flange is increased in diameter in a form of a disk to thereby have the diameter larger than the diameter of the flange portion of the magnetic barrel body.

12. The fuel injection valve as claimed in claim 5, wherein the chamfer portion covering substantially the entire circumference of the outer periphery of the flange is shaped substantially into a taper.

13. The fuel injection valve as claimed in claim 5, wherein the chamfer portion covering substantially the entire circumference of the outer periphery of the flange is shaped substantially into an arc.

14. The fuel injection valve as claimed in claim 5, wherein the outer periphery of the flange overhangs outward from the outer periphery of the flange portion of the magnetic barrel body, and the overhanging covers an area around substantially an entire circumference of the outer peripheries of the flange and the flange portion.

15. A fuel delivery system, comprising:

a fuel delivery pipe formed with a boss portion; and a fuel injection valve adapted to be mounted to the fuel delivery pipe in such a manner as to be connected to the boss portion, the fuel injection valve comprising:

I) a magnetic barrel body made of a magnetic material and shaped substantially into a barrel, the magnetic barrel body including;

a) a fuel passage, and b) a flange portion disposed at a first end on a fuel's influx side connected to a fuel delivery pipe, the flange portion having a diameter so formed as to expand;

II) a core barrel made of a magnetic material and shaped substantially into a barrel, the core barrel being inserted into the magnetic barrel body;

III) a valve seat member positioned on a downstream side of the core barrel and disposed in the magnetic barrel body, the valve seat member including a valve seat for communicating a fuel;

IV) a valve body positioned between the core barrel and the valve seat member, the valve body being disposed in the magnetic barrel body, the valve body being so displaced as to be seated on the valve seat of the valve seat member and to be separated from the valve seat of the valve seat member;

V) an O-ring positioned in a vicinity of the flange portion of the magnetic barrel body, the O-ring being so disposed on an outer periphery on the fuel's influx side of the magnetic barrel body as to seal an area defined between the fuel delivery pipe and the magnetic barrel body, the O-ring in a progress of being mounted on the outer periphery on the fuel's influx side of the magnetic barrel body being free from abutting on the flange portion of the magnetic barrel body; and VI) a fuel filter assembly disposed at the first end on the fuel's influx side of the magnetic barrel body, the fuel filter assembly collecting a foreign matter in the fuel flowing in from the fuel delivery pipe, the fuel filter assembly including a flange abutting on the flange portion of the magnetic barrel body, the flange of the fuel filter assembly being made of a material lower in hardness than the magnetic material of the magnetic barrel body, the flange of the fuel filter assembly having a diameter larger than the diameter of the flange portion of the magnetic barrel body.

16. The fuel delivery system as claimed in claim 15, wherein the magnetic barrel body further comprises a large diameter portion, a middle diameter portion and a small diameter portion such that the magnetic barrel body is shaped substantially into a stepped barrel, and the large diameter portion is disposed axially on a first side of the magnetic barrel body, the middle diameter portion in an axial middle part of the magnetic barrel body is smaller than the large diameter portion, and the small diameter portion is disposed axially on a second side of the magnetic barrel body and smaller than the middle diameter portion.

17. The fuel delivery system as claimed in claim 16, wherein the O-ring is disposed between the outer periphery of the large diameter portion and an inner periphery of the boss portion of the fuel delivery pipe.

18. The fuel delivery system as claimed in claim 15, wherein the first end on the fuel's influx side of the magnetic barrel body is fitted with the flange portion having the outer periphery covered with flange fitted to fuel filter assembly, thereby, inserting the first end of the magnetic barrel body into the boss portion of the fuel delivery pipe prevents the flange portion from abutting on the boss portion, resulting in a prevention of a foreign matter including a cutting piece.

19. The fuel delivery system as claimed in claim 15, wherein the outer periphery of the flange overhangs outward from the outer periphery of the flange portion of the magnetic barrel body, and the overhanging covers an area around substantially an entire circumference of the outer peripheries of the flange and the flange portion.

* * * * *